US005871688A

United States Patent [19]

Jaworski et al.

[11] Patent Number: 5,871,688

[45] Date of Patent: Feb. 16, 1999

[54] MULTI-STACK ANNEALER

[75] Inventors: James D. Jaworski, Crown Point, Ind.; Frank C. Gilbert, Brecksville, Ohio

[73] Assignee: North American Manufacturing Company, Cleveland, Ohio

[21] Appl. No.: 907,333

[22] Filed: Aug. 6, 1997

[51] Int. Cl.[6] ..... C21D 1/06

[52] U.S. Cl. ..... 266/256; 266/263; 432/254.1

[58] Field of Search ..... 266/256, 262, 266/263; 432/77, 206, 254.1

[56] References Cited

U.S. PATENT DOCUMENTS

| | | | |
|---|---|---|---|
| 901,956 | 10/1908 | Creighton | 432/206 |
| 2,169,621 | 8/1939 | Taylor | 432/206 |
| 2,414,130 | 1/1947 | Wilson | 266/256 |
| 4,142,712 | 3/1979 | Hemsath et al. | 266/262 |

*Primary Examiner*—Scott Kastler
*Attorney, Agent, or Firm*—Jones, Day, Reavis & Pogue

[57] ABSTRACT

An annealing furnace is disclosed including at least one inner cover for retaining a stack of metal coils to be annealed in an inert atmosphere. A furnace shell is provided for receiving said at least one inner cover and providing an internal furnace environment. A furnace floor is provided for retaining the furnace shell and inner cover. A plurality of burners are received in said furnace floor, and configured around the inner cover so as to fire into the internal furnace environment along side the inner cover without impingement of the flame on the inner cover. A control system sequentially fires each of said plurality of burners in order to establish and maintain a desired thermal distribution among the stacks within the inner cover.

7 Claims, 3 Drawing Sheets

MULTI-STACK ANNEALER

BACKGROUND OF THE INVENTION

The present invention is directed to the field of annealers for processing sheet metal. An annealing step is typically performed in the manufacture of sheet metal, especially steel. Coils of metal are program heated up to a desired temperature and cooled down in order to relieve stresses within the metal.

Annealing systems typically include a furnace cover for establishing a containment perimeter for the furnace. A plurality of burners are retained within the wall of the furnace cover for firing horizontally inward toward the load. A stack of metal coils are retained inside an inner cover within the furnace. The inner cover encloses a chemically inert atmosphere around the load (typically 90% nitrogen and 10% hydrogen). This atmosphere serves as both the vehicle for transferring heat from the inner cover to the load as well as the protective atmosphere to prevent oxidation of the strip.

In previous systems, the best annealing quality is obtained using a single-stack annealer, i.e. one furnace and cover for each stack of coils. This type of system insures a high degree of temperature uniformity and control over numerous system variables. However, single-stack annealers are expensive to purchase since furnace covers are costly regardless of the size. However, single-stack annealers are capital intensive, primarily due o the cost of the furnace covers and base system, regardless of the size. Additionally, single-stack annealers require significantly more floor space per unit of production than do multi-stack furnaces.

These cost-effectiveness issues can be addressed by providing a multi-stack annealing furnace in which a plurality of stacks (typically between two and eight) are annealed within one furnace cover. Each stack has its own dedicated inner cover base fan, atmosphere supply and control thermocouple. All of the stacks are retained under a single furnace cover, which is a refractory-lined combustion chamber to which is mounted the burners and ancillary equipment. Such a furnace typically includes two thermocouples—one to limit the furnace temperature and the other as a master temperature control element. Due to capitalization costs, ambient air temperature and complexity, the furnace combustion system is designed to function as a single zone of control.

The furnace covers are raised, lowered and transported using a crane. During crane movement and positioning, it is not uncommon for the cover-mounted burners to be sheared off or damaged if the cover is dropped or misaligned during transporting and positioning of the cover. The inadvertent dropping of a coil exposes the furnace cover to similar damage.

A typical multi-stack annealing furnace uses flat flame burners alone or in combination with forward flame burners. Flat flame burners are designed to provide heat to the adjacent refractory in order to radiate heat back to the load. However, most modern annealing furnace designs have replaced traditional heavy refractory firebrick with lightweight ceramic fiber blankets. Such fiber blankets do not store heat, and thus cannot radiate heat to the load, thereby reducing heat transfer and efficiency of the system.

Forward flame burners are somewhat more effective at directly transferring heat to the load. However, forward flame burners produce a flame which can directly impinge upon the inner cover. Over time, the inner cover is burned up and destroyed by such impingement. Given that the cost of each furnace cover can currently exceed $15,000.00, such flame impingement significantly contributes to costs by shortening the useful life of the inner cover. Impingement can be reduced by enlarging the size of the furnace cover or reducing the outside diameter of the inner cover, which in turn dictates a reduction in the size of the load. However, this is also undesirable since the useful volume for retaining product is reduced, thus lowering yield for a given quantity of expended fuel.

Multi-stack annealers are less expensive to operate than single-stack systems due to such things as fewer crane lifts and costs associated with reduced floor space. Various factors influence the heating cycle of the coils within each stack, such as the weight and dimensions of the load and grade of material. Thermocouples can be used within each inner cover to monitor temperature for each stack. To prevent over heating of a particular stack, it is common for operators to manually adjust the burners, which can result in an upset of the air/fuel ratio, which in turn may provide for local impingement on an inner cover. Manual adjustments can also cause heating cycle delays, which results in inefficient fuel consumption and produce less yield per unit time. The multi-stack process has inherently always been 1½ to 2 times longer than the single-stack process, and such delays contribute further to reduced yield and efficiency.

Manual adjustment also upsets the temperature balance in the system, creating thermal differentials throughout the load that upset the uniformity of the annealing process, resulting in lower-quality product as compared with the quality of the single-stack process. Flame supervision can be provided, but such usually assumes simultaneous burner operation. If any burner fails, the entire system shuts down, resulting in a significant loss of process time while spoiling the quality of the load. High ambient conditions generally reduce the life of the flame supervisory equipment.

BRIEF DESCRIPTION OF THE INVENTION

In view of the aforementioned drawbacks and disadvantages with previous annealers, there is therefore a need for a multi-stack annealer that produces single-stack quality product.

There is also a need for a multi-stack annealer with the ability to control the temperature of each stack.

There is also a need for an annealer with improved safety.

There is also a need for an annealer using high radiation burners without flame impingement.

There is also a need for an annealer with increased production and reduced cycle time.

There is also a need for an annealer with reduced installation and upgrade costs.

These needs and others are satisfied by the annealing furnace of the present invention comprising at least one inner cover for retaining a stack of metal coils to be annealed in an inert atmosphere. A furnace shell is provided for receiving said at least one inner cover and providing an internal furnace environment. A furnace floor is provided for retaining the furnace shell and inner cover. A plurality of burners are received in said furnace floor, and configured around the inner cover so as to fire into the internal furnace environment along side the inner cover at a sufficient distance to preclude impingement of the flame on the inner cover. A control system sequentially fires each of said plurality of burners in order to establish and maintain a desired thermal distribution among the stack within the inner cover.

The above and other needs which are satisfied by the present invention will become apparent from consideration of the following detailed description of the invention as is particularly illustrated in the accompanying drawings.

DETAILED DESCRIPTION OF THE INVENTION

Figure 1:
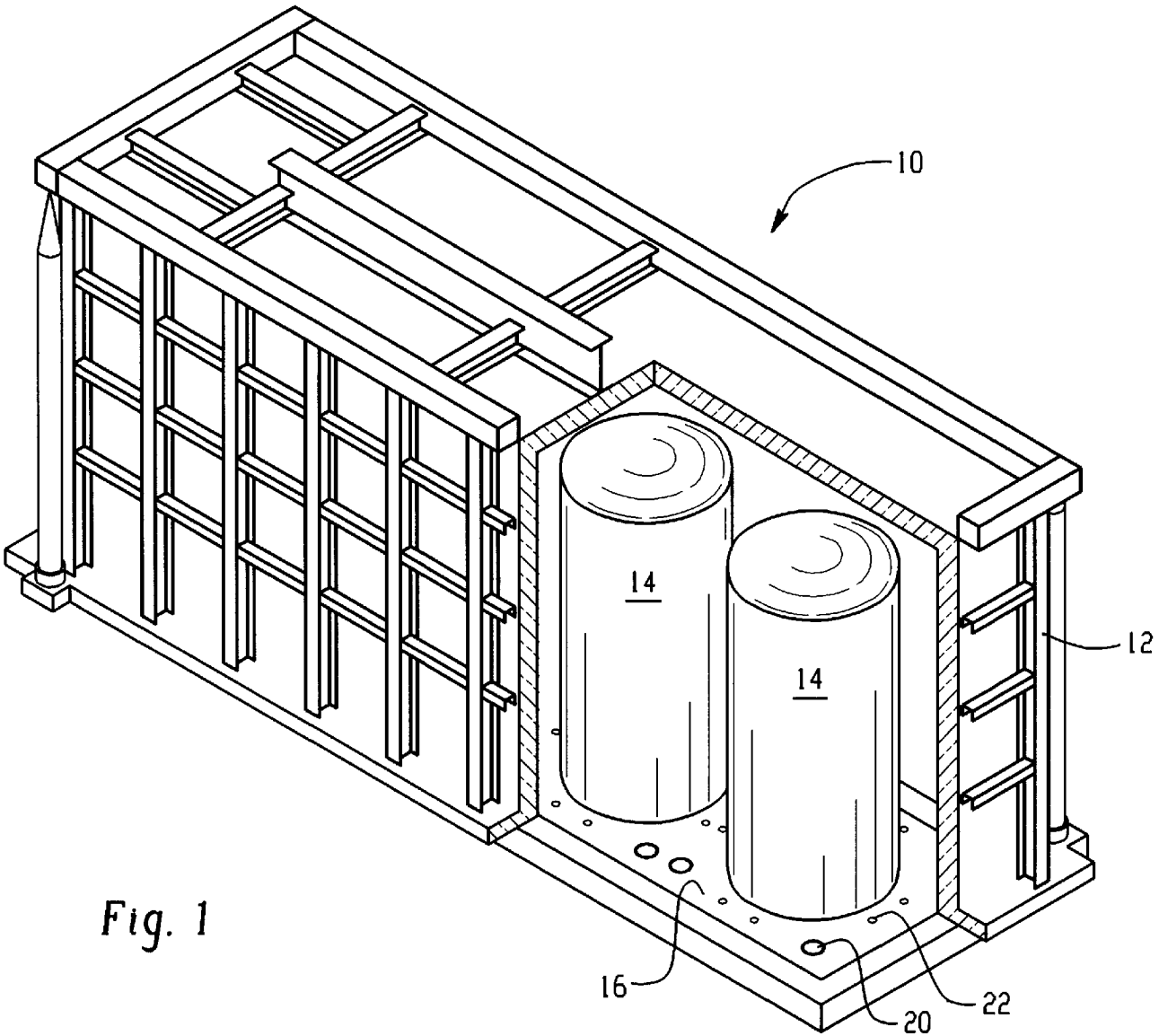
FIG. 1 is a perspective view showing a multi-stack annealer according to the present invention.
Figure 2A:
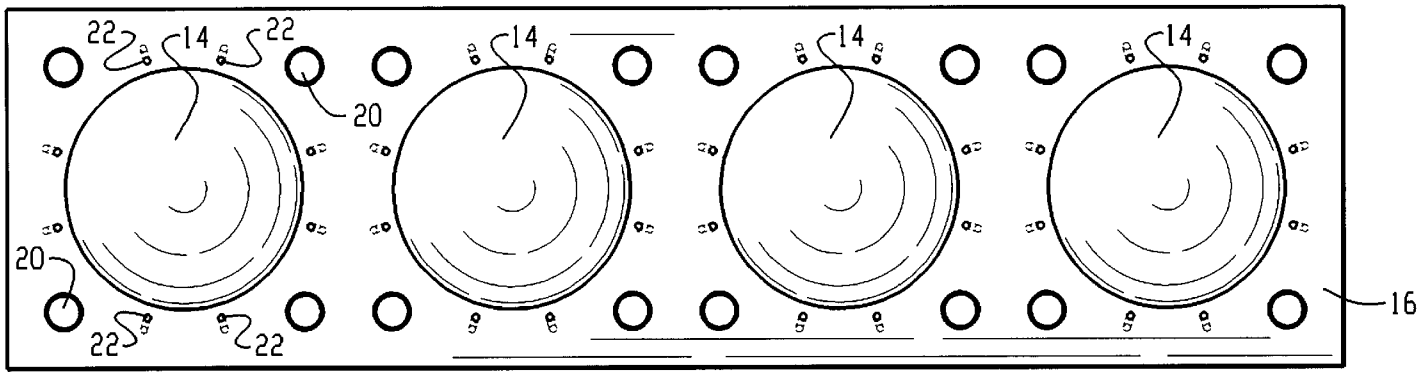
FIGS. 2A and 2B are respective overhead and side views showing the burner and stack configuration of the present invention.
Figure 2B:
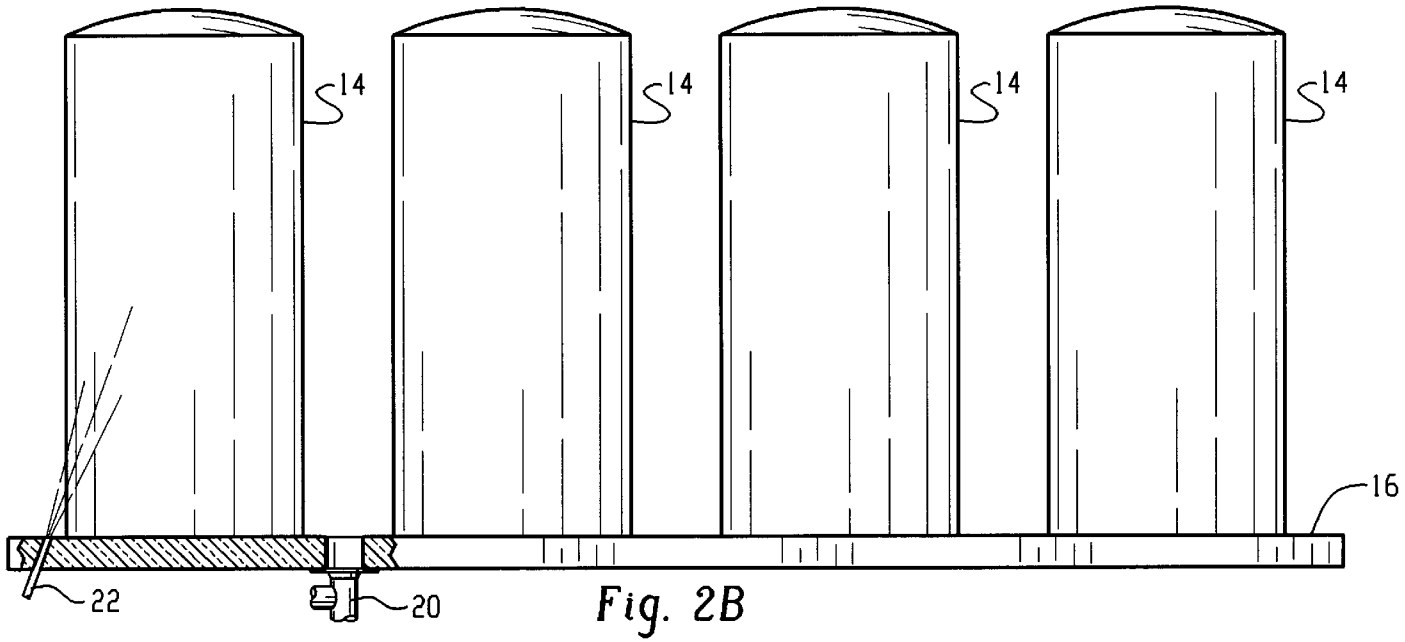
Figure 3:
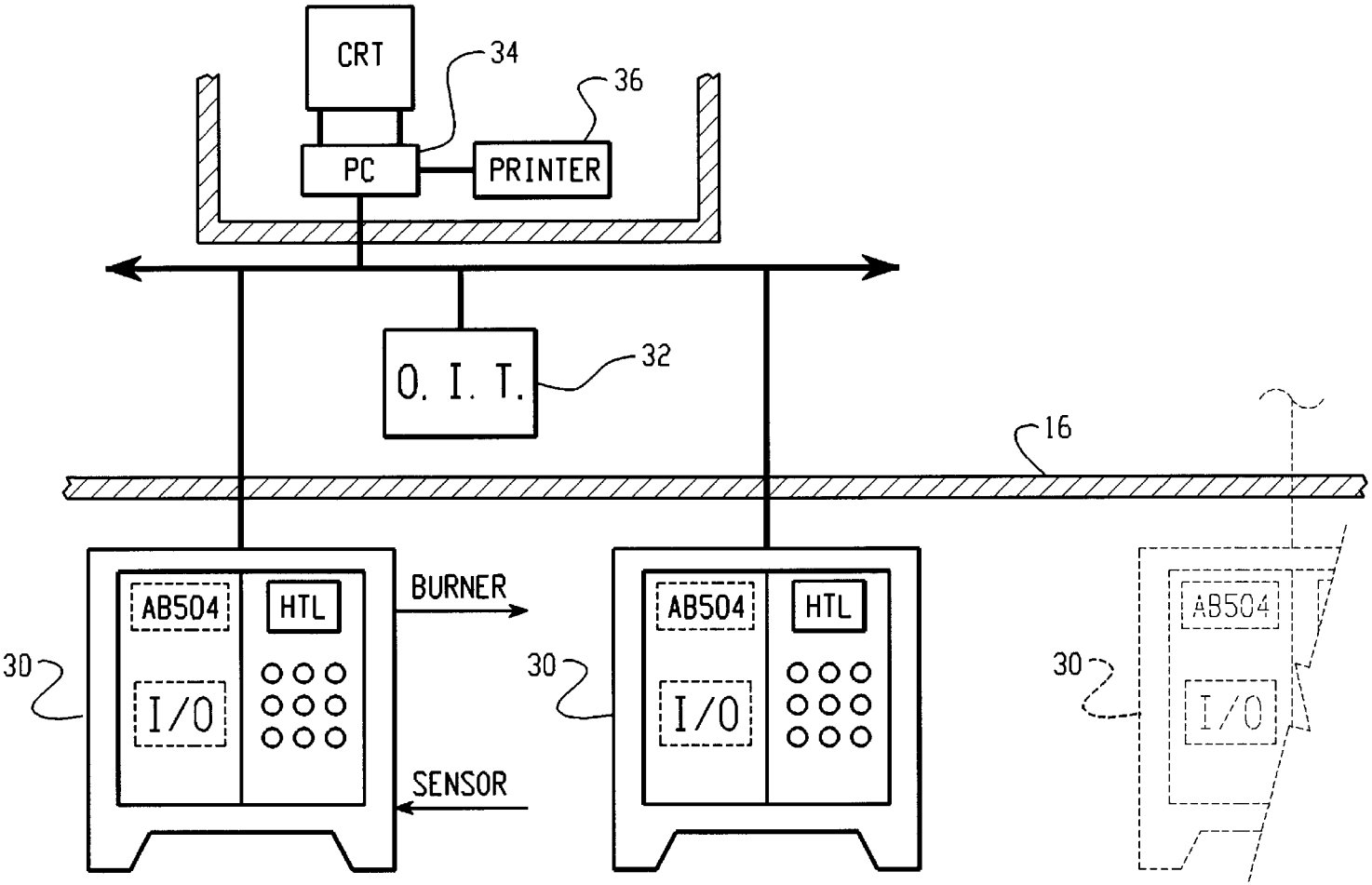
FIG. 3 is a schematic showing the control system of the present invention.

Turning now to the figures, an annealing furnace 10 is shown as according to the present invention, including a furnace cover 12 and a plurality of inner covers 14, seated on the furnace floor 16, for retaining a stack of metal coils to be annealed. The illustrated embodiment depicts a four-stack annealer, however it should be appreciated that the principles of the invention can be adapted to a multi-stack annealer of any size (e.g. between two and eight or more stacks). The invention has further applicability as applied to a single-stack annealer, which would also benefit from many of the advantages derived from the novel concepts disclosed herein.

With the present invention, the burners 20 are mounted within the furnace floor 16 so as to surround each inner cover 14. The burners 20 are fired vertically upward through the floor 16, parallel to the exterior surfaces of the inner cover 14. Low velocity burners are preferably used, having a short-to-medium-length, luminous flame with a high proportion of radiant heat transfer to the inner cover 14. Also, the burners 20 are preferably located very close to the inner cover 14, at a sufficient distance so as to optimize radiant heat transfer and distribution without the risk of direct flame impingement, thereby increasing the useful life of the inner cover 14. In the preferred embodiment, each inner cover 14 has a specific number of dedicated burners (preferably four) that supply heat to the respective stack. Also, separate control is established over each burner 20 so that the thermal condition of each stack can be controlled separately, in relative isolation with the adjacent stacks. In this way, multiple zones can effectively be established within a single multi-stack furnace, thus bringing single-stack control (and quality) to a multi-stack system.

With the present system, the burners 20 are each sequentially fired in a desired duty cycle so as to provide precise heat transfer to the stack. For example, in an embodiment having four burners 20 configured around an inner cover 14, the burners 20 may all be fired at once, or some burners 20 may fire while others are turned off, with the firing state of each burner 20 being staggered over time according to a particular firing cycle to produce and maintain a desired heating condition.

In the preferred embodiment, the burners 20 are fired according to an automated process. A programmable logic controller (P.L.C.) 30 is located near the furnace or under the stack near the burners, the circulating fan and the air and fuel supplies. An operator interface 32 is provided for controlling operation. A control system 34, preferably a remote personal computer, is provided for monitoring, data storage and recipe downloading. Printers, modems and other peripheral interfaces 36 can be provided for upward/downward communication between the components and for managing and processing information connected to the burner firing and the annealing process.

Burner firing is conducted by the control system 34 according of one of a number of prescribed recipes which are selected according to the size, type and weight of the load, in addition to other process variables. The control system 34 can vary burner operation between high fire (i.e. stoichiometric firing) and low fire, where the burner is "turned down" on ratio or by adding a significant quantity of excess air. However, low fire excess air operation reduces flame temperature without reducing fuel consumption since air is simply added to the thermal load. It is therefore the preferred embodiment of the invention to vary each burner 20 between a high fire state and an "off" state, as according to the North American Manufacturing StepFire™ process. High fire provides the preferable burner characteristics of stoichiometric firing and high fuel efficiency, along with maximum convective and radiative heat transfer.

During operation, a temperature "ramp/soak" recipe is selected through the control system. The recipe is loaded into the P.L.C. 30, which oversees combustion safety systems, programmed burner ignition, and automatic purging within the cycle. Each burner 20 is supervised by the control system 34. In this way, cycles can be run even if some of the burners 20 are out of service. The furnace cover temperature is monitored by the P.L.C. 30 through a sensor (not shown) which provides feedback information to the control system 34.

Each inner cover 14 includes a dedicated control thermocouple (not shown) which is used as an input for the firing cycle in the control loop of the P.L.C 30. The measured temperature is compared to a programmed set point, and the burners 20 adjacent to the stack are fired sequentially for a required cycle time to maintain a desired temperature. In this way, different size coils and loads can be individually controlled, eliminating the manual adjustments of previous systems and the related problems, while providing single-stack quality.

Using individual flame supervision to oversee the StepFire™ operation eliminates furnace shutdowns and provides a balanced heat release across the inner cover 14. The firing pattern of the burners 20 can be sequenced to account for the overlaps in the firing of adjacent burners, and also to account for radiation from adjacent stacks.

In addition, air jets 22 can be provided, configured around the furnace floor 16, for use in the cooling section of an annealing recipe. This increases convective heat transfer during cooling, thus shortening cooling time. These air jets 22 are also controlled by the control system 34.

With the present invention, cycle time for a multi-stack annealer is reduced to close to the time required for a single-stack annealer, as compared to the 1½ to 2 times required for previous multi-stack systems. All burner and ancillary equipment is located remote from the furnace cover 12, and so the furnace cover 12 can be constructed with reduced weight and expense. Also, since the risk of damage or shearing off of the equipment is avoided, the occasions for unplanned maintenance and the resulting down time are reduced. Thus, the present invention significantly reduces maintenance and operational costs.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

We Claim:

1. An annealing furnace comprising:

at least one inner cover for retaining a stack of metal coils to be annealed in an inert atmosphere;

a furnace shell for receiving said at least one inner cover and providing an internal furnace environment;

a furnace floor for retaining the furnace shell and inner cover;

a plurality of burners, received in said furnace floor, and configured around the inner cover so as to fire into the internal furnace environment along side the inner cover without impingement of the flame on the inner cover;

a control system for sequentially firing each of said plurality of burners in order to establish and maintain a desired thermal distribution among the stack within the inner cover.

2. The annealing furnace of claim 1 further comprising a plurality of inner covers for each retaining a respective stack of metal coils, wherein each inner cover includes its own respective plurality of burners.

3. The annealing furnace of claim 2 wherein the number of inner covers is between two and eight.

4. The annealing furnace of claim 1 wherein the burners are low velocity burners that produce a flame with convection and radiative heat transfer.

5. The annealing furnace of claim 1 wherein the control system includes a plurality of sensors for monitoring the thermal distribution within the furnace in order to regulate the sequential firing of the burners.

6. The annealing furnace of claim 1 wherein the control system includes a programmable lottic controller that varies burner operation between high fire and an off condition.

7. The annealing furnace of claim 1 further including a plurality of cooling jets located around the inner cover for reducing cooling time of the stack.

* * * * *

UNITED STATES PATENT AND TRADEMARK OFFICE

CERTIFICATE OF CORRECTION

PATENT NO. : 5,871,688
DATED : February 16, 1999
INVENTOR(S) : James D. Jaworski; Frank C. Gilbert It is certified that error appears in the above-indentified patent and that said Letters Patent is hereby corrected as shown below:

Claim 6, Line 15 should read as follows:

system includes a programmable lo[tt]gic controller that varies

Signed and Sealed this

First Day of June, 1999

*Attest:*

*Attesting Officer*

Q. TODD DICKINSON

*Acting Commissioner of Patents and Trademarks*